US012805652B2

(12) United States Patent
Amundsen et al.

(10) Patent No.: US 12,805,652 B2
(45) Date of Patent: Nov. 24, 2026

(54) BABY CARRIER

(71) Applicant: hope&plum LLC, Minneapolis, MN (US)

(72) Inventors: Amanda Skye Amundsen, Kensington, MD (US); Mallory Bransfield, Richfield, MN (US)

( * ) Notice: Subject to any disclaimer, the term of this patent is extended or adjusted under 35 U.S.C. 154(b) by 22 days.

(21) Appl. No.: 18/775,871

(22) Filed: Jul. 17, 2024

(65) Prior Publication Data

US 2026/0020692 A1 Jan. 22, 2026

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/158–160
See application file for complete search history.

(56) References Cited

U.S. PATENT DOCUMENTS

| | | | | |
|---|---|---|---|---|
| 4,986,458 | A * | 1/1991 | Linday | A47D 13/025 224/648 |
| 10,194,731 | B2 * | 2/2019 | Guthrie | A45C 13/103 |
| 10,264,895 | B2 * | 4/2019 | Lindeman | A47D 13/025 |
| 11,219,317 | B2 * | 1/2022 | Telford | A45F 3/047 |
| 11,490,741 | B1 * | 11/2022 | Pa | A47D 13/025 |
| 12,246,235 | B2 * | 3/2025 | Coonts | A63B 69/3608 |
| 2007/0152007 | A1 * | 7/2007 | Kauss | A45F 3/14 224/148.2 |
| 2014/0097215 | A1 * | 4/2014 | Caperon | A47D 13/025 224/160 |

* cited by examiner

*Primary Examiner* — Adam J Waggenspack

(57) ABSTRACT

A versatile, wearable carrier for a baby or child is provided. The carrier has a body portion having a bottom end defining a channel to receive an adjustable belt securable about a wearer's waist. The belt is anchored to a central portion of the channel so that the remainder of the channel may be scrunched around the belt to adjust the width of the bottom end of the body portion. Adjustable shoulder straps extend from the top end of the body portion and have elongated inner and outer edges folded inward and secured at the top end of the body portion. A plurality of anchors are disposed on the shoulder straps to engage an adjustable, ergonomic chest strap. Each shoulder strap includes a fastener for removably securing to any fasteners disposed on the side of the body portion so that they may be optionally worn in an X or H-configuration.

13 Claims, 7 Drawing Sheets

BABY CARRIER

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to baby and child carriers and, more particularly, to baby and child carriers configured to enable both front and back carrying according to the wearer's needs or preferences while being ergonomically adjustable to the individual size of both wearer and baby or child.

BACKGROUND

There comes a time when many parents and caregivers reach a crossroads: hold their baby or child, or maintain the use of their own arms and hands. As a result of this all-too-common experience, many hands-free, wearable baby and/or child carriers are available on the marketplace.

In general, these are formed like slings or packs that anchor the baby or child to the wearer's torso from the wearer's shoulder(s) and waist. Some exemplary baby and/or child carriers include U.S. Pat. No. 10,912,394 to Young for a baby carrier system having a selectively changeable waist strap; U.S. Pat. No. 7,766,199 to Caperon, teaching an arrangement of fasteners that enable selective adjustment of the width of the carrier at the hips of a baby placed therein; U.S. Pat. No. 9,877,596 to Schaarschmidt for a small child and baby carrier that teaches multiple configurations for a carry bag portion of the carrier relative to its waist strap, enabled by snaps. In particular, it may be seen that these examples feature elements that enable adjustment of the carrier along the baby or child's hips. This is because failing to properly support a baby's legs in a wide, bent "M-shaped" position relative to their hips is thought to risk injury to the baby's hips and spine due to the weight of the baby's legs pulling downward on the hip joints, which can result in or exacerbate hip dysplasia. These proposals remain deficient, however. For instance, properly changing out waist belts and engaging fiddley snaps require dexterity and coordination that may not be available to some. In addition, none sufficiently teach ergonomically configuring a baby or child carrier to account for the size of both wearer and baby or child. This can have deleterious effects on the wearer's own body, which may not necessarily be conditioned to support the weight of a growing baby or child for extended periods of time.

Those proposals which attempt to provide additional support via a structure waistband configured to anchor the carrier at the wearer's hips, such as U.S. Pat. No. 10,939,744 to Robinson et al., can cause discomfort through the wearer's waist and abdomen. This discomfort can be particularly pronounced for the baby or child's birthing parent due to the anatomical changes that result from childbirth, especially those who have experienced cesarean sections resulting in scar tissue. In addition, such configurations do not allow for vertical adjustment of the waistband along the wearer's torso, which limits accommodation for different heights and body proportions.

All of these deficiencies can be particularly frustrating, if not physically harmful, to the wearer and/or baby or child in situations where the wearer would prefer to wear their baby or child on their back rather than their front, either due to physical ability or personal preference.

Thus, although various proposals have been made to solve the problems, none of those in existence combine the characteristics of the present invention. Therefore, there remains a need for a baby and/or child carrier that ergonomically distributes the weight of a carried baby or child across the wearer's body and further can be ergonomically adapted to accommodate a variety of baby and/or child and wearer sizes in multiple wearing configurations.

SUMMARY

The present disclosure is directed to baby carriers configured to enable both front and back carrying according to the wearer's needs or preferences while being ergonomically adjustable to both wearer and baby size. It is contemplated that the carrier may be configured to support the weight of either a baby or a small child up to, for example, about 45 to 50 pounds or even 60 to about 65 pounds. However, in the interest of brevity, the device may simply be referred to as a carrier or baby carrier herein, and the baby or child may be referred to as the "occupant" without limiting the invention.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In one embodiment, the carrier may comprise a body portion having an inside, which will contact and support the occupant's body when in use, an outside, a top end, and bottom end that defines a channel to receive an adjustable belt securable about a wearer's waist. A first side edge and second side edge are spaced apart by and extend between the top and bottom ends. In some embodiments, the top end defines a shallow, convex curve that may approximately correspond to the bottom of an occupant's—i.e. the aforementioned baby or child's—head, neck, and even shoulders.

The belt may be anchored to a central portion of the channel, leaving the remainder of the channel free to be scrunched around the belt to optionally adjustment of the width of the bottom end of the body portion in order to account for the size of the wearer and/or occupant. The belt need not be anchored to the channel to practice the invention, however, it is contemplated that anchoring the belt to a central portion of the channel, such as by stitching the belt to the channel, will ensure that ergonomic features of the belt, such as any padding or shaping, remain fixed in place against the wearer's body relative to the body portion of the carrier. Indeed, in some embodiments, the belt may comprise an elongated, padded portion that is configured to rest within the channel and cushion and/or support the weight of an occupant against the body of the wearer.

In one exemplary embodiment, additional lengths of adjustable webbing may extend from opposing ends of the elongated, padded portion, and comprise a slide buckle as well as fasteners, such as a side release buckle, that enables securement of the belt about the wearer's body. It is contemplated, however, that the belt may comprise a length of any material and may be secured about the wearer's body by tying, weaving through rings or slide buckles, or with fasteners other than a side release buckle such as by complementary hook and loop fasteners, snaps, clips, or any other fasteners capable of maintaining the belt about the body of a wearer.

Adjustable shoulder straps extend from opposing sides of the top end of the body portion of the carrier. Each strap may have elongated inner and outer edges on opposing sides of a centerline, with portions of these edges folded inward and secured at the top end of the body portion to permit adjustment of the width of the shoulder strap, reduce interference with the occupant's head when worn, provide additional cushioning, and direct and distribute the weight of the occupant across the width of the wearer's shoulders and upper back and torso.

In some embodiments, each shoulder strap may comprise a fastener for removably securing the straps to any fasteners disposed on or extending from the first and second side edges of the body portion. In other words, a first and second fastener extend from each first and second side edge of the body portion of the carrier, respectively, and are operative to engage with fasteners disposed on either of the shoulder straps. It is contemplated that such fasteners are operative to optionally engage with either strap fastener in order to permit fastening the straps in multiple configurations relative to the body portion of the carrier. That is, it is contemplated that a strap fastener may be engagable with a same-side side edge fastener or an opposite-side side edge fastener, allowing for ergonomically carrying the occupying baby or child at the front of the wearer's torso with the straps engaged in an X-configuration across the wearer's back or carrying the occupying baby or child along the wearer's back with the straps engaged in an H-configuration across the wearer's front. These optional configurations will be made clearer with reference to the figures below.

With particular consideration for the optional H-configuration of the straps, a plurality of anchors are also disposed along a portion of the elongated inner edge of each strap to engage an adjustable chest strap. The plurality of anchors may be a plurality of webbing loops positioned one over another to enable adjustment of the vertical position of chest strap in order to ergonomically accommodate wearers of different heights. More particularly, when the body portion of the carrier is positioned to hold an occupant along the wearer's back, the chest strap may be engaged across the wearer's chest via the strap anchors to distribute the weight of the occupant more evenly across the wearer's shoulders and upper body. This may reduce strain on the shoulders and prevent the occupant from pulling backward and may further promote better posture and comfort to the wearer and safety to the occupant. In addition, the chest strap may stabilize the occupant by preventing the body portion from sliding off or shifting unexpectedly. This may beneficially improve the wearer's balance and coordination, which in turn provides safety to the occupant.

In some embodiments, the adjustable chest strap is fitted with a slide buckle, known to those of ordinary skill in the art, which allows a user to selectively change the length of the chest strap to accommodate their individual chest width. Means for engaging the chest strap with one each of the plurality of anchors are disposed on opposing ends of the chest strap. In some embodiments, such means may comprise a G-hook, though other hooks may be used without departing from the invention.

In some embodiments, the plurality of anchors may be visually obscured by the material defining the shoulder straps. It is contemplated that this preserves the aesthetic appearance of the carrier and also prevents the chest strap from becoming inadvertently dislodged while in use.

It is contemplated that providing a baby or child carrier according to the disclosure and claims provided below may provide an ergonomic and versatile option for caregivers to maintain their bodily connection with their baby or child while still maintaining the use of their hands.

Thus, it is an object of the invention to provide a baby or child carrier that can be worn on the front of the torso or at the back.

It is another object of the invention to provide a baby or child carrier that can comfortably fit wearers of different sizes.

It is still another object of the invention to provide a baby or child carrier that can accommodate babies or children of varying sizes.

It is yet another object of the invention to improve the comfort of a parent or caregiver carrying a baby or child.

One or more of the above-disclosed embodiments, in addition to certain alternatives, are provided in further detail below with reference to the attached figures. The disclosed subject matter is not, however, limited to any particular embodiment disclosed.

Figure 1:
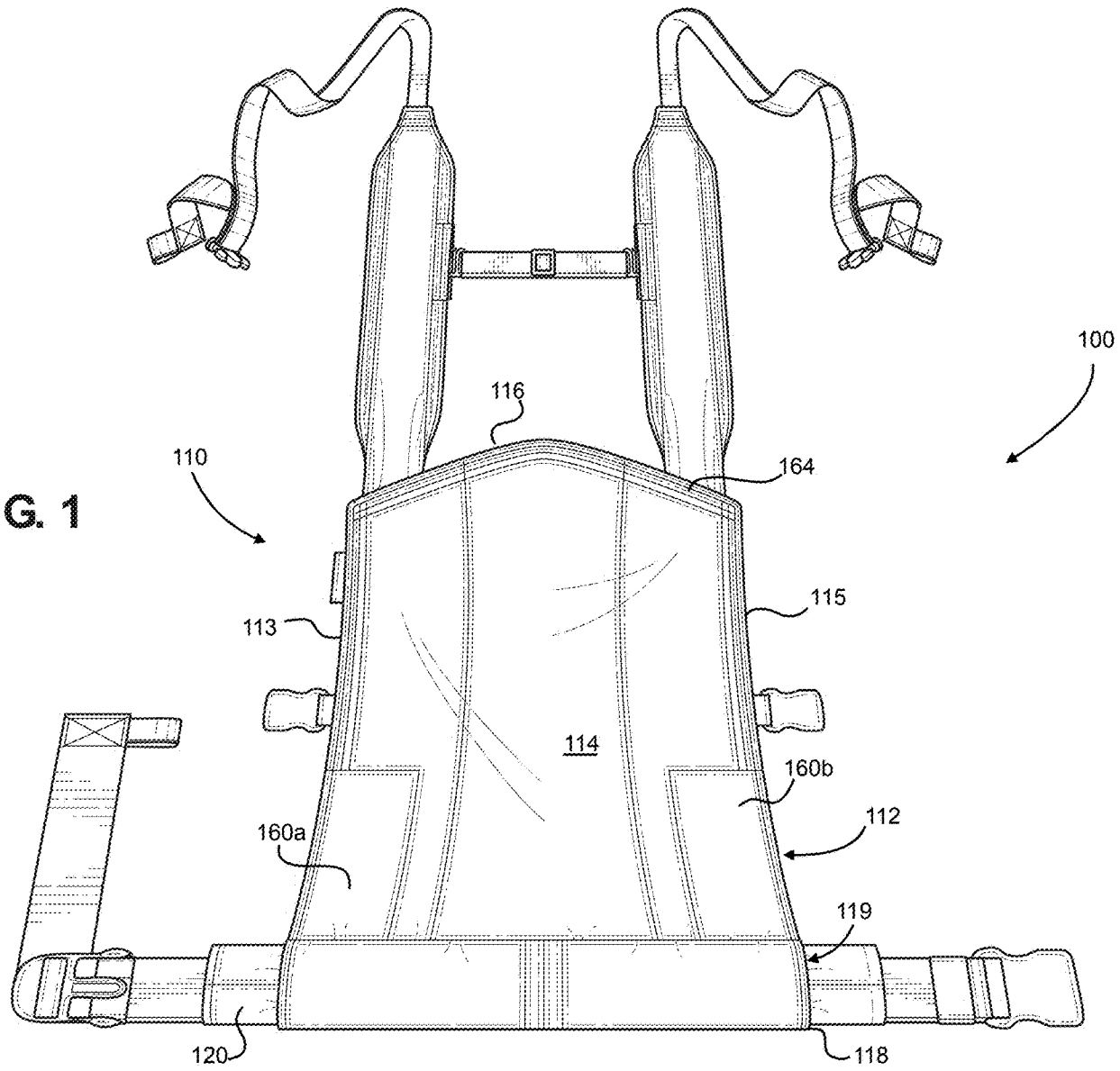
FIG. 1 shows an outside view of one embodiment of the baby carrier.

The disclosed embodiments may be better understood by referring to the figures in the attached drawings, as provided below. The attached figures are provided as non-limiting examples for providing an enabling description of the method and system claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

Figure 2:
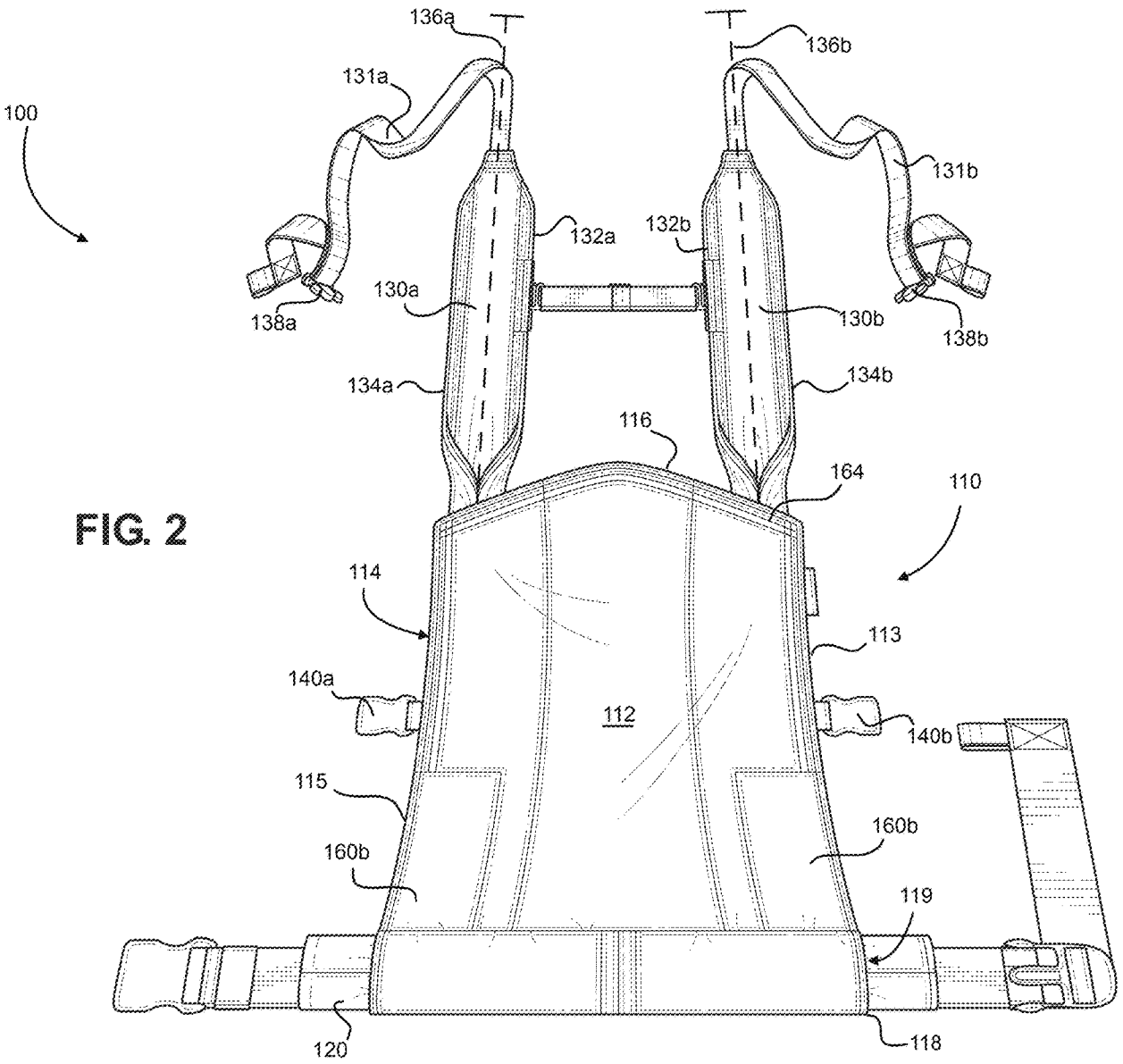
FIG. 2 shows an inside view of one embodiment of the baby carrier.

With reference to FIGS. 1 and 2, in one embodiment, the carrier 100 may comprise a body portion 110 having an inside 112, an outside 114, a top end 116, and bottom end 118 that defines a channel 119 to receive an adjustable belt 120 securable about a wearer's waist. A first side edge 113 and second side edge 115 are spaced apart by and extend between the top and bottom ends 116, 118. In some embodiments, the top end 116 defines a shallow, convex curve that may approximately correspond to the bottom of an occupant's head, neck, and even shoulders or upper back.

Figure 3:
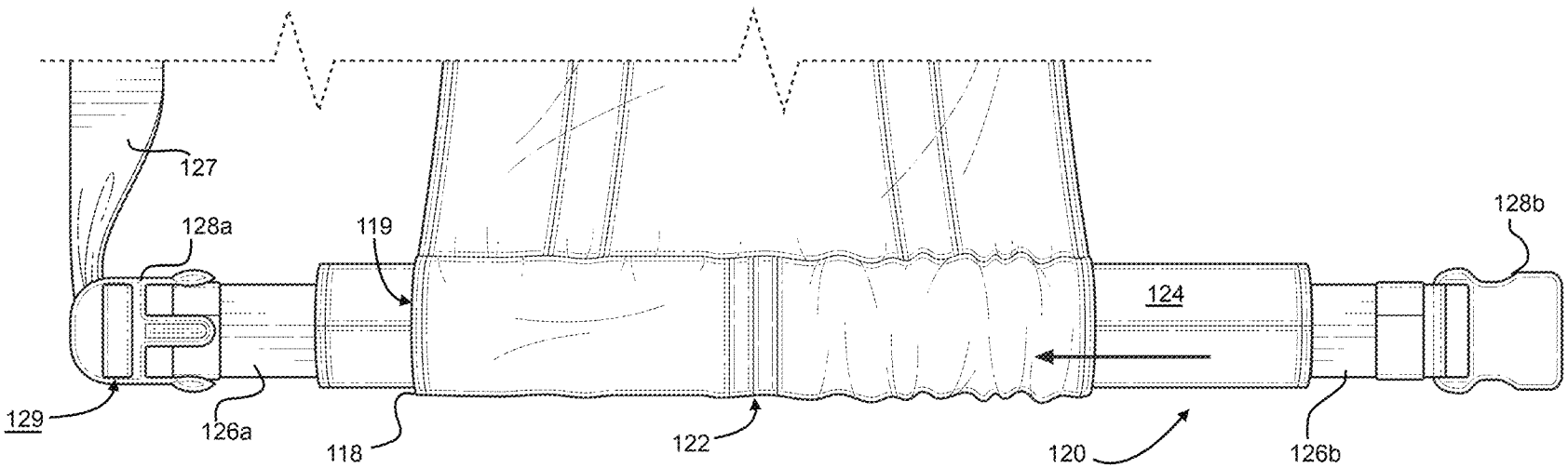
FIG. 3 shows a detailed view of a chest strap of the baby carrier in accordance with one embodiment.

Turning to FIG. 3 the belt 120 may be anchored to a central portion 122 of the channel 119, leaving the remainder of the channel 119 free to be scrunched around the belt in a manner that permits optional adjustment of the width of the bottom end of the body portion to account for the size of the wearer and/or occupant. In the exemplary embodiment, it may be seen that the belt 120 is anchored to the central portion 122 by a series of stitched lines, however, additional means for anchoring the belt 120 within the channel 119 may be utilized, such as glue.

In addition, the belt 120 need not be permanently anchored to the channel 119 to practice the invention, however, it is contemplated that anchoring the belt 120 to a central portion of the channel 122, such as by stitching the belt to the channel, will ensure that ergonomic features of the belt, such as any padding or shaping, remain fixed in place against the wearer's body relative to the body portion of the carrier. Indeed, in some embodiments, the belt 120 may comprise an elongated, padded portion 124 that is configured to rest within the channel 119 and cushion and/or support the weight of an occupant against the body of the wearer.

In one exemplary embodiment, additional lengths of adjustable synthetic, natural, or semi-synthetic webbing 126*a*, 126*b* may extend from opposing ends of the elongated, padded portion 124, and comprise fasteners, such as a side release buckle 128*a*, 128*b*, that enables securement of the belt 120 about the wearer's body. A slide buckle may be provided separately to enable adjustment of the webbing 126*a*, 128*b* or otherwise integrated on a portion of the fastener as indicated at 129. One of ordinary skill in the art will recognize, then, that adjusting the belt 120 may be achieved in such nonlimiting embodiments but pulling a tail end 127 of the belt to reduce the radius of a fastened belt 120. It is contemplated, however, that the belt 120 may comprise a length of any material and may be secured about the wearer's body by tying, weaving through rings or slide buckles, or with fasteners other than a side release buckle such as by complementary hook and loop fasteners, snaps, clips, or any other fasteners capable of maintaining the belt about the body of a wearer. Still, it should be noted that providing padding to a limited portion of the belt 120 in combination with webbing in this manner may enhance the wearer's comfort by reducing bulk and weight of the device through the belt and reducing the amount of material available to capture and retain body heat.

With reference again to FIG. 2 in particular, adjustable shoulder straps 130*a*, 130*b* extend from opposing sides of the top end 116 of the body portion 110 of the carrier 100. Each strap 130*a*. 130*b* may have elongated inner edges 132*a*, 132*b* and outer edges 134*a*, 134*b* on opposing sides of a centerline 136*a*, 136*b*, with portions of these edges 132*a*, 132*b*, 134*a*, 134*b* folded inward and secured at the top end 116 of the body portion 110 to permit adjustment of the width of the shoulder strap 130*a*, 130*b*, as needed or desired, reduce interference with the occupant's head when worn, provide additional cushioning, and direct and distribute the weight of the occupant across the width of the wearer's shoulders and upper back and torso.

Similar to the belt 120, the shoulder straps 130*a*, 130*b* may comprise a relatively broad fabric portion configured to distribute the weight of a loaded occupant, a length of natural, synthetic, or semi-synthetic webbing 131*a*, 131*b* which may be provided to reduce bulk through the shoulder straps 130*a*, 130*b* in those areas where the length of the straps may be adjusted to fit a particular user. As shown in FIGS. 1, 2, 4, and 5B, it may be seen that shoulder straps 130*a*, 130*b* taper unfolded along a remaining portion toward and adjacent to the webbing 131*a*, 131*b*, in order to provide a secure attachment to such webbing and reduce insulating bulk.

In some embodiments, each shoulder strap 130*a*, 130*b* may comprise a fastener 138*a*, 138*b* for removably securing the straps 130*a*, 130*b* to any fasteners disposed on or extending from the first and second side edges 113, 115 of the body portion 110. In other words, a first and second fastener 140*a*, 140*b* extend from each first and second side edge 113, 115 of the body portion 110 of the carrier 100, respectively and are operative to engage with fasteners 138*a*, 138*b* disposed on either of the shoulder straps 130*a*, 130*b*. It is contemplated that such fasteners 140*a*, 140*b* are operative to optionally engage with either strap fastener 138*a*, 138*b* in order to permit fastening the straps in multiple configurations relative to the body portion 110 of the carrier. That is, it is contemplated that a strap fastener may be engagable with a same-side side fastener or an opposite-side side fastener e.g. strap fastener 138*a* with either of side fasteners 140*a*, 140*b*, and strap fastener 138*b*, with either of side fasteners 140*a*, 140*b*). As above, a slide buckle may be provided separately to enable adjustment of the webbing 131*a*, 131*b* or otherwise integrated on a portion of the fastener 138*a*, 138*b* as in the figures.

Figure 5A:
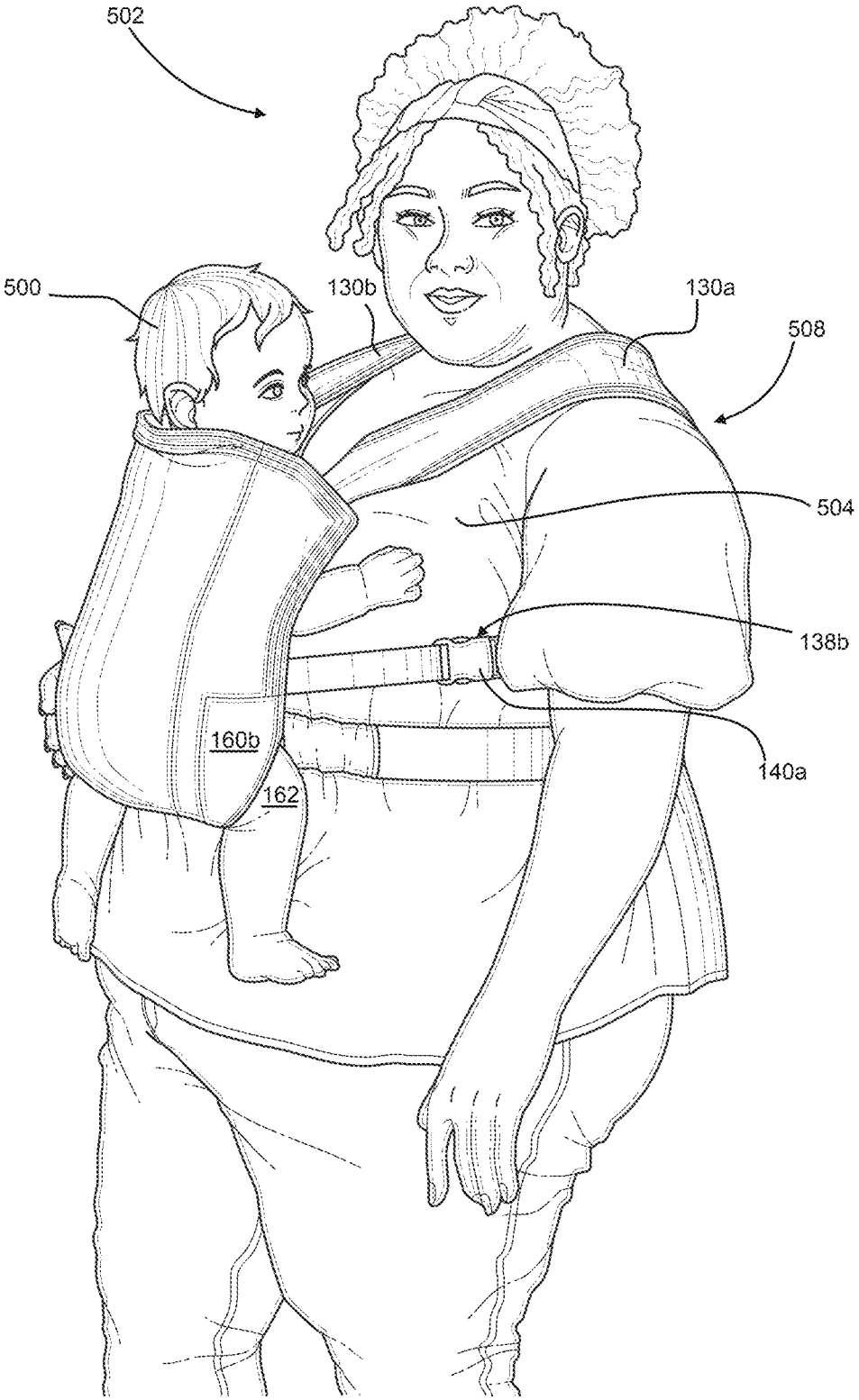
FIGS. 5-6 shows various embodiments of the baby carrier in use.
Figure 5B:
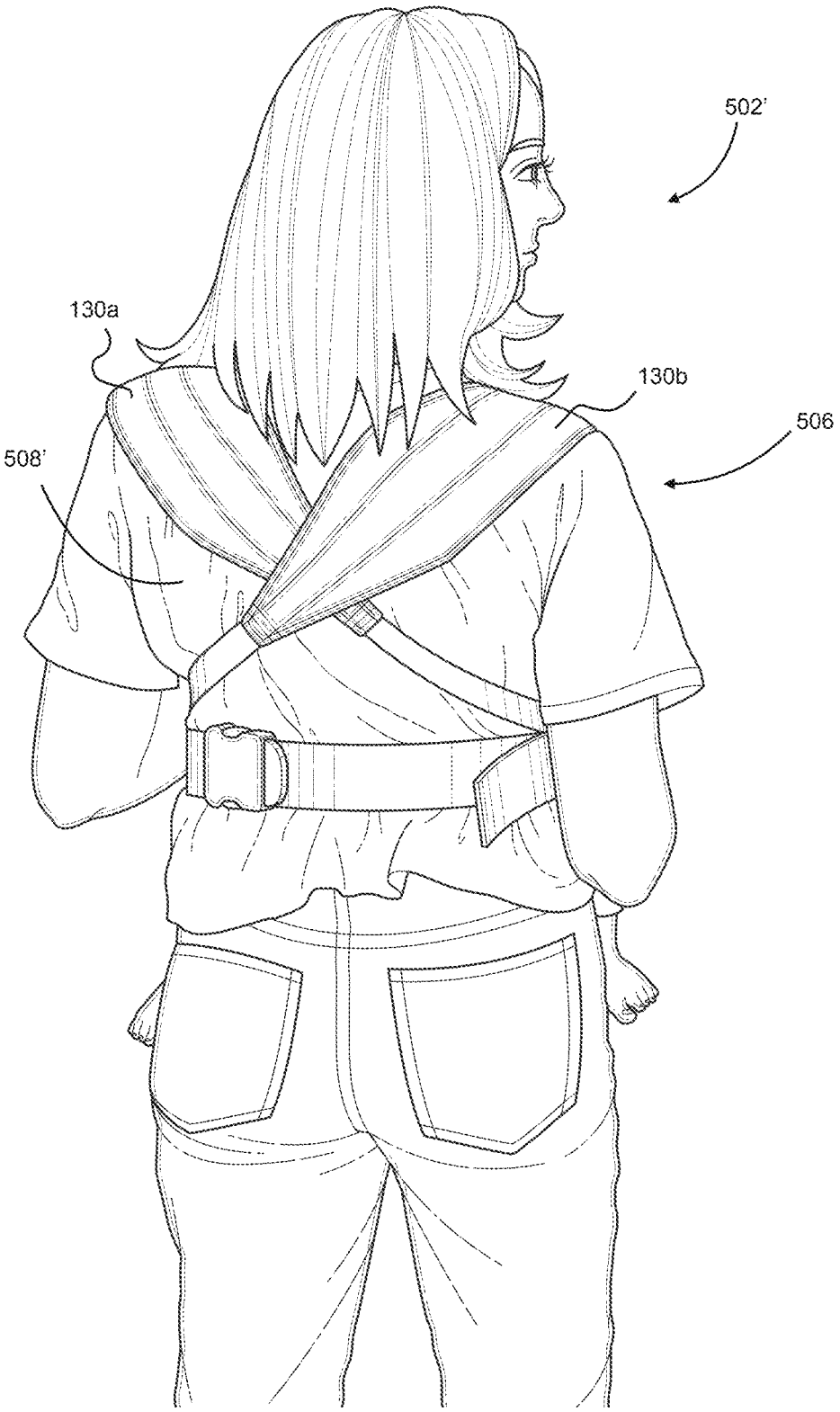

FIGS. 5A and 5B illustrate alternative front and back views of certain embodiments of the device being utilized to carry a baby or child along a wearer's front 501 or torso. In the embodiment reflected in FIG. 5A, strap fastener 138*b* is engaged with side fastener 140*a* to enable the wearer 502, 502' to ergonomically carry an occupying baby 500 or child at the front of the wearer's 502, 502' torso 504 with the straps engaged in an X-configuration 506 across the wearer's back 508, 508', as shown, for example, in FIG. 5B.

In a manner known to those of ordinary skill in the art, adjusting the shoulder straps 130*a*, 130*b* may be achieved by pulling a tail end of the webbing (obscured in the figures) to adjust the position of the slide buckle along the webbing and effectively reduce the radius of a fastened shoulder strap about the wearer.

It is contemplated that configuring the device to wear the straps in an X-configuration not only may distribute the weight of an occupant 500 around and across the wearer's back 508, 508' but also may reduce the chance that the straps 130*a*, 130*b* slip off the wearer's shoulders, which could be dangerous to the occupant. This also avoids any need to engage a safety device at the wearer's upper back, which is difficult if not impossible for some who experience limited mobility in the shoulders and upper back.

Figure 6:
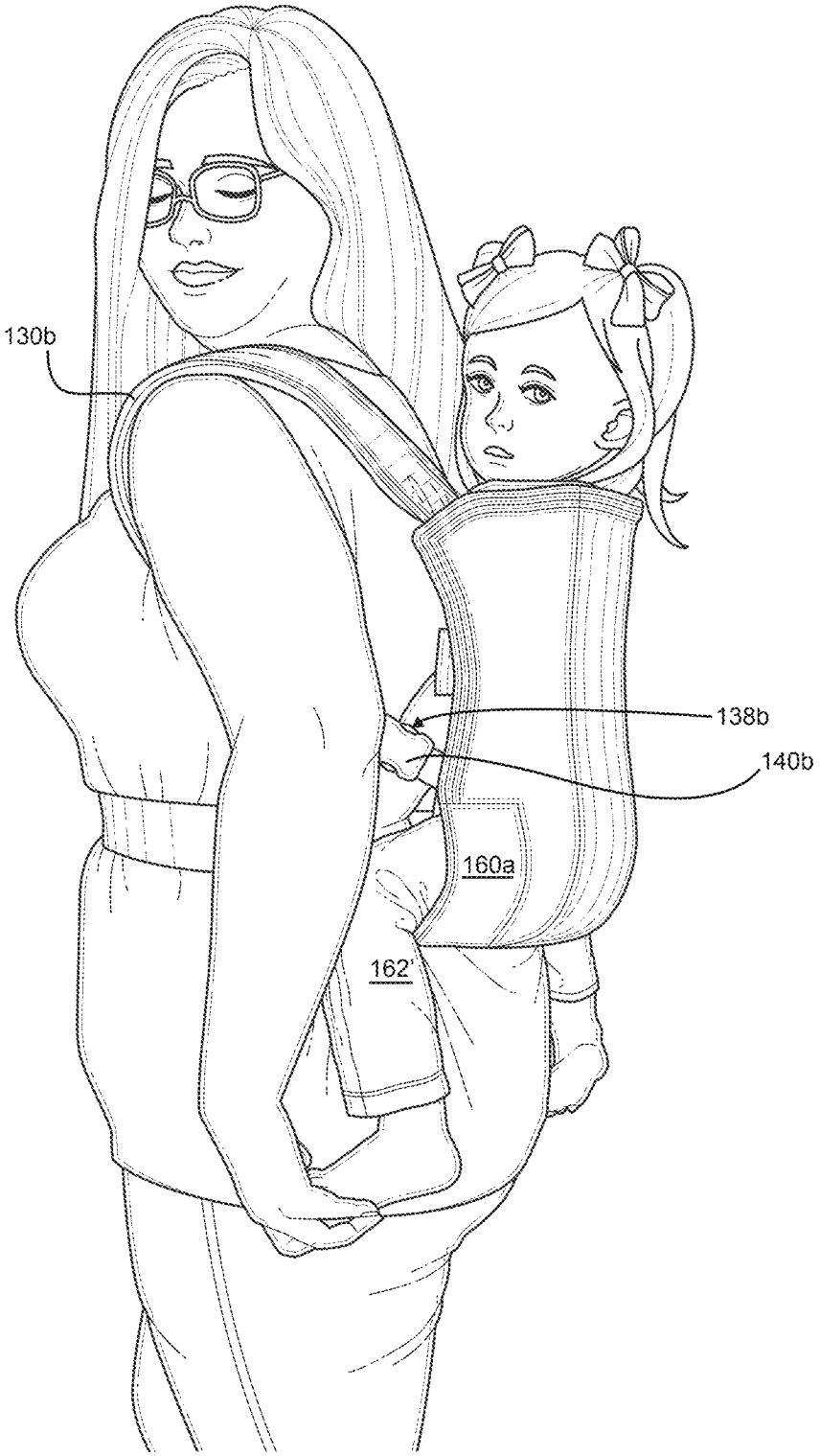

FIG. 6 additionally illustrates a method of fastening strap 130*b* via fastener 138*b* to the same-side side fastener 140*b* to enable carrying an occupant along the wearer's back 508' with the straps engaged in an H-configuration across the wearer's front (obscured in this figure by the wearer's body).

Figure 4:
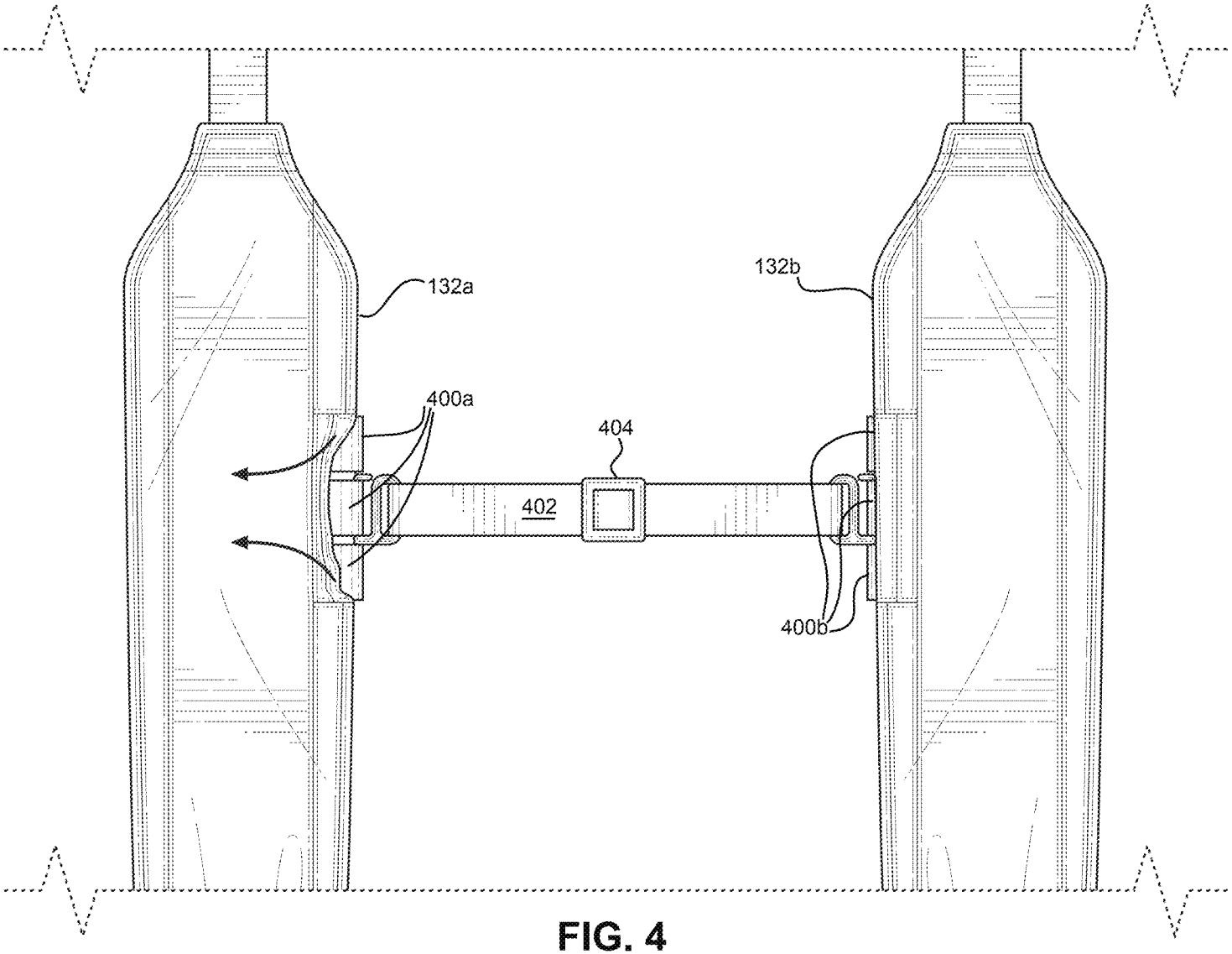
FIG. 4 shows a detailed view of a belt of the baby carrier in accordance with one embodiment.

The optional H-configuration of the straps may be better understood with reference to FIG. 4. In particular, a plurality of anchors 400*a*, 400*b* may be disposed along a portion of the elongated inner edge 132*a*, 132*b* of each strap 130*a*, 130*b* to engage an adjustable chest strap 402. The plurality of anchors 400*a*, 400*b* may be a plurality of rugged webbing loops positioned one over another to enable adjustment of the vertical position of chest strap 402 in order to ergonomically accommodate wearers of different heights. More particularly, when the body portion of the carrier is positioned to hold an occupant along the wearer's back, as in exemplary FIG. 6, the chest strap 402 may be engaged across the wearer's chest via the strap anchors 400*a*, 400*b* to distribute the weight of the occupant more evenly across the wearer's shoulders and upper body and further prevent the straps 130*a*, 130*b* from slipping off the wearer's shoulders. This may reduce strain on the shoulders and prevent the occupant from pulling backward and may further promote better posture and comfort to the wearer and safety to the occupant. In addition, the chest strap 402 may stabilize the occupant by preventing the body portion from sliding off or shifting unexpectedly. This may beneficially improve the wearer's balance and coordination, which in turn provides safety to the occupant.

In some embodiments, the adjustable chest strap 402 is also webbing, and may be fitted with a slide buckle 404, known to those of ordinary skill in the art, which allows a user to selectively change the length of the chest strap 402 to accommodate their individual chest width. Means for engaging the chest strap 402 with one each of the plurality of anchors 400*a*, 400*b* are disposed on opposing ends of the chest strap. In some embodiments, such means may comprise a G-hook 406*a*, 406*b*, though other hooks, clips, or even snaps may be used without departing from the invention.

In some embodiments, the plurality of anchors may be visually obscured by the material defining the shoulder straps as demonstrated in exemplary FIG. 4. It is contemplated that this enhances the aesthetic appearance of the carrier and also prevents the chest strap 402 from becoming inadvertently dislodged while in use.

With reference to FIGS. 5A, 5B, and 6, the carrier 100 may be configured as an "apron-style" carrier. Thus, when in use, the inside 112 of the body portion 110, including the channel 119 defined by the bottom end 118 of the body portion 110, may define a hammock-like seat that contacts and supports the occupant's body across their thighs and rear end. To do so, the outside 114 of the body portion 110 may be secured to the wearer's body at or above their waist by the belt 120. The location of the belt 120 may be vertically adjusted around the wearer's torso for the wearer's comfort and preference and according to the size of the occupant. Thus it may be seen that all occupants and wearer's in the exemplary figures are different sizes from one another. Indeed, the depth of the hammock defined by the body portion 110 may be adjusted by vertically adjusting the belt 120 along the wearer's body and placement of the occupant's rear end along the inside 112 of the body portion 110 as well in order to accommodate occupants of various sizes. Likewise, the channel 119 may be scrunched or cinched around the belt 120 to render the bottom end 118 of the body portion 110 more narrow to more comfortably and ergonomically support a smaller baby or child across their thighs and rear end.

One of ordinary skill in the art will recognize that although babies and children are shown and referenced throughout, this is for example only and not limitation. The age of the occupant shall not limit the invention, and the size of the occupant should only be limited in so far as carrying or being carried in this manner is unsafe to the occupant or wearer.

Various elements of the carrier 100, such as those portions of the carrier that are not webbing, may be formed as sheets of material, layered or individually, such as cotton, hemp, linen, wool, silk, and rayon fabric such as rayon offered under the tradename Tencel™, or combinations of any of the foregoing. In some embodiments, the material is a natural, breathable material, however, it is contemplated that synthetic materials, such as polyester, nylon, neoprene, and the like may be used as well without departing from the invention. Indeed, it is contemplated that these may be selected for their moisture wicking, quick drying, and rugged properties, though their use is not required to practice the invention.

In some embodiments, the body portion 110 of the carrier 100 and at least some portion of the belt 120 and shoulder straps 130 comprise inner and outer layers of material such as those listed above. These may be sewn together in any manner known to those of ordinary skill in the art with an intervening layer of cotton or polyester batting, or the like, to reinforce the body portion 110 while avoiding adding uncomfortable weight to the carrier 100. It is contemplated that the batting may be layered or built up to provide additional cushioning in certain zones in order to reduce or relieve pressure or strain. In some embodiments, the padding may be foam. In some embodiments padded zones may be selected to provide comfort while simultaneously avoiding capturing and maintaining heat throughout the entire device.

For instance, in some embodiments, such as shown in FIGS. 1 and 2, padding 160 may be disposed adjacent to the first and second side edges 113, 115 just above the belt 120 in order to cushion a child's legs while wearing the device. This cushioning can be seen, for example, in FIGS. 5A and 6, in which padding 160*a*, 160*b* corresponds to the occupants' legs 162, 162'. In addition, the belt 120 and shoulder straps 130 may be padded to improve comfort and provide reinforcement to those portions of the carrier that distribute the weight of a carried baby or child across the body of the wearer.

Additional reinforcement may be provided along the top end 116 of the body portion 110 to prevent the body portion 110 of the carrier 100 from stretching or deforming, or otherwise slow or reduce stretching or deforming in this region, due to contact with the occupant's head, neck, upper back, and/or shoulders. In some embodiments, this reinforcement may comprise a series of top stitched rows 164, though it is contemplated that additional padding or even additional layers of material, such as self-fabric or even interfacing known to those of skill in the art, may be provided in this area as well.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the aesthetic appearance of any fabrics and/or webbing comprising the device may vary without departing from the invention. Accordingly, it is intended that the invention not be limited, except as by the appended claim(s).

The teachings disclosed herein may be applied to other systems, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the baby carrier with which that terminology is associated. In general, the terms used in the following claims should not be constructed to limit the baby carrier to the specific embodiments disclosed in the specification unless the above description section explicitly define such terms. Accordingly, the actual scope encompasses not only the disclosed embodiments, but also all equivalent ways of practicing or implementing the disclosed system, method and apparatus. The above description of embodiments of the baby carrier is not intended to be exhaustive or limited to the precise form disclosed above or to a particular field of usage.

While specific embodiments of, and examples for, the method, system, and apparatus are described above for illustrative purposes, various equivalent modifications are possible for which those skilled in the relevant art will recognize.

While certain aspects of the method and system disclosed are presented below in particular claim forms, various aspects of the method, system, and apparatus are contemplated in any number of claim forms. Thus, the inventor reserves the right to add additional claims after filing the application to pursue such additional claim forms for other aspects of the baby carrier.

What is claimed is:

1. A wearable carrier, comprising;

a body portion having an inside and an outside, a top end, a bottom end defining a channel, a first side edge, and second side edge, the side edges spaced apart by and extending between the top and bottom ends;

a first and second side fastener extending from the first and second side edges of the body portion, respectively;

an adjustable belt disposed within the channel and securable about a wearer's upper body, the channel being scrunchable around the belt to enable adjustment of the width of the channel;

a first and second adjustable shoulder strap extending from opposing sides of the top end of the body portion, each strap having an elongated inner and outer edge on opposing sides of a strap centerline, a portion of each inner and outer edge proximate to the body portion of the carrier folded inward toward the strap centerline and secured in place at the top end of the body portion, and a length of webbing extending opposite the top end of the body portion, each strap tapering unfolded along a remaining portion toward and adjacent to the webbing to reduce bulk, and each strap comprising a fastener operative to removably secure such strap to either one of the first and second side fasteners;

a plurality of anchors disposed along the elongated inner edge of each shoulder strap; and an adjustable chest strap defined by a first end and second end, each end comprising means for optionally and alternatively engaging one each of the plurality of anchors.

2. The wearable carrier of claim 1, wherein the belt disposed within the channel is further anchored to a central portion of the channel to maintain the belt in a fixed position relative to the body portion of the carrier, and the remainder of the channel continues to be scrunchable around the belt to optionally enable adjustment of the width of the channel.

3. The wearable carrier of claim 1, wherein the belt comprises an elongated, central, padded portion having a first end and a second end and a length of webbing extending from each of the first and second ends and comprising fasteners selectively engageable with one another, wherein the elongated, central, padded portion is anchored to the body portion of the carrier within the channel.

4. The wearable carrier of claim 1, wherein the shoulder straps comprise a fabric portion proximate to the body portion of the carrier and a webbing portion distal to the body portion and permanently secured to a distal end of the fabric portion, wherein such distal end of the fabric portion is tapered relative to the remainder of the fabric portion.

5. The wearable carrier of claim 1, wherein the means for optionally and alternatively engaging one each of the plurality of anchors is a hook.

6. The wearable carrier of claim 5, wherein the hook is a G-hook.

7. The wearable carrier of claim 1, wherein the first and second side fasteners and shoulder strap fasteners comprise matable side release buckles.

8. The wearable carrier of claim 7, wherein the belt and shoulder straps comprise slide buckles arranged to permit adjustment to the length of such belt and straps.

9. The wearable carrier of claim 7, comprising padding disposed adjacent to the first and second side edges just above the belt and operative to cushion an occupant's legs while in use.

10. The wearable carrier of claim 7, comprising a layer of batting interposed between an inner and outer layer of fabric operative to reinforce the wearable carrier and provide cushioning to the wearer and occupant.

11. A device for carrying a baby or child, comprising;

a body portion having an inside and an outside, a top end, a bottom end defining a channel, a first side edge, and second side edge, the side edges spaced apart by and extending between the top and bottom ends;

a portion of a side release buckle extending from one each of the first and second side edges of the body portion, respectively;

an adjustable belt comprising an elongated, padded portion and a first and second webbing portion extending from opposing ends of the elongated, padded portion and having fasteners operative to secure the belt about a wearer's upper body, the belt disposed within and anchored to the channel by stitching, and the channel being scrunchable around the belt to enable adjustment of the width of the channel;

a first and second adjustable shoulder strap extending from opposing sides of the top end of the body portion, each strap having an elongated inner and outer edge on opposing sides of a strap centerline, a portion of each inner and outer edge proximate to the body portion of the carrier folded inward toward the strap centerline and secured in place at to the top end of the body portion, each strap comprising a length of webbing extending opposite the top end of the body portion, the shoulder strap tapering unfolded along a remaining portion toward and adjacent to the webbing to provide a secure attachment to the webbing and reduce bulk, a portion of a slide release buckle adjustable along the length of the webbing and operative to matably and removably secure such strap to either one of the first and second side edge side release buckles;

a plurality of anchors disposed along the elongated inner edge of each shoulder strap and visually obscured by any fabric defining the shoulder strap; and an adjustable chest strap comprising a slide buckle and defined by a first end and second end, each end comprising means for optionally and alternatively engaging one each of the plurality of anchors.

12. The device of claim 11, wherein the means for optionally and alternatively engaging one each of the plurality of anchors is a hook.

13. The device of claim 11, wherein the hook is a G-hook.

* * * * *